US010531215B2

(12) United States Patent
Kim et al.

(10) Patent No.: US 10,531,215 B2
(45) Date of Patent: Jan. 7, 2020

(54) 3D SOUND REPRODUCING METHOD AND APPARATUS

(75) Inventors: Sun-min Kim, Yongin-si (KR); Young-jin Park, Daejeon Metropolitan (KR); Hyun Jo, Daejeon Metropolitan (KR)

(73) Assignees: SAMSUNG ELECTRONICS CO., LTD., Suwon-si (KR); KOREA ADVANCED INSTITUTE OF SCIENCE AND TECHNOLOGY, Daejeon-si (KR)

( * ) Notice: Subject to any disclaimer, the term of this patent is extended or adjusted under 35 U.S.C. 154(b) by 524 days.

(21) Appl. No.: 13/177,903

(22) Filed: Jul. 7, 2011

(65) Prior Publication Data

US 2012/0008789 A1 Jan. 12, 2012

Related U.S. Application Data

(60) Provisional application No. 61/362,014, filed on Jul. 7, 2010.

(30) Foreign Application Priority Data

Dec. 28, 2010 (KR) ..... 10-2010-0137232
Apr. 13, 2011 (KR) ..... 10-2011-0034415

(51) Int. Cl.
*H04S 3/00* (2006.01)
*H04S 5/00* (2006.01)
(Continued)

(52) U.S. Cl.
CPC ..... *H04S 3/002* (2013.01); *H04S 5/00* (2013.01); *H04R 5/02* (2013.01); *H04R 17/00* (2013.01);
(Continued)

(58) Field of Classification Search
CPC ..... H04S 2420/01; H04S 2420/07; H04S 2400/11; H04S 5/00; H04S 7/00; H04S 3/004; H04R 5/02; H04R 17/00
(Continued)

(56) References Cited

U.S. PATENT DOCUMENTS 5,173,944 A 12/1992 Begault
5,412,732 A * 5/1995 Kanishi et al. ..... 381/18
(Continued)

FOREIGN PATENT DOCUMENTS

CN 1753577 A 3/2006
CN 102595153 A 7/2012
(Continued)

OTHER PUBLICATIONS

Hamasaki et al, 5.1 and 22.2 multichannel sound productions using integrated surround sound panning system, 2004.*
(Continued)

*Primary Examiner* — Davetta W Goins
*Assistant Examiner* — Kuassi A Ganmavo
(74) *Attorney, Agent, or Firm* — Sughrue Mion, PLLC

(57) ABSTRACT

Provided are a three-dimensional (3D) sound reproducing method and apparatus. The method includes transmitting sound signals through a head related transfer function (HRTF) corresponding to a first elevation, generating a plurality of sound signals by replicating the filtered sound signals, amplifying or attenuating each of the replicated sound signals based on a gain value corresponding to each of speakers, through which the replicated sound signals will be output, and outputting the amplified or attenuated sound signals through the corresponding speakers.

19 Claims, 9 Drawing Sheets

(51) Int. Cl.
*H04S 7/00* (2006.01)
*H04R 5/02* (2006.01)
*H04R 17/00* (2006.01)

(52) U.S. Cl.
CPC ..... *H04S 3/004* (2013.01); *H04S 7/00* (2013.01); *H04S 7/302* (2013.01); *H04S 2400/11* (2013.01); *H04S 2420/01* (2013.01); *H04S 2420/07* (2013.01)

(58) Field of Classification Search
USPC ..... 381/17, 310, 309, 303, 313, 18, 19, 20, 381/21, 22, 23, 27
See application file for complete search history.

(56) References Cited

U.S. PATENT DOCUMENTS 5,742,689 A 4/1998 Tucker et al.
5,802,180 A 9/1998 Abel et al.
5,802,181 A * 9/1998 Ozaki et al. ..... 381/18
5,812,674 A 9/1998 Jot et al.
5,910,990 A 6/1999 Jang
6,078,669 A 6/2000 Maher
6,421,446 B1 7/2002 Cashion et al.
6,442,277 B1 8/2002 Lueck et al.
6,498,856 B1 12/2002 Itabashi et al.
6,577,736 B1 6/2003 Clemow
6,766,028 B1 * 7/2004 Dickens ..... H04S 3/004 381/17
6,795,556 B1 9/2004 Sibbald et al.
6,839,438 B1 1/2005 Riegelsberger et al.
7,113,602 B2 9/2006 Oinoue et al.
7,382,885 B1 * 6/2008 Kim ..... H04S 3/02 381/1
7,391,877 B1 6/2008 Brungart
7,561,706 B2 7/2009 Holmi et al.
7,590,248 B1 9/2009 Chen et al.
7,599,498 B2 10/2009 Kim et al.
7,860,260 B2 * 12/2010 Kim ..... H04S 7/302 381/17
7,889,870 B2 * 2/2011 Chun ..... H04S 3/00 381/1
8,135,151 B2 3/2012 Watanabe
8,155,357 B2 * 4/2012 Kim et al. ..... 381/310
8,290,167 B2 * 10/2012 Pulkki et al. ..... 381/23
2003/0095669 A1 5/2003 Belrose et al.
2003/0123676 A1 7/2003 Schobben
2004/0086129 A1 * 5/2004 Schobben et al. ..... 381/18
2004/0105550 A1 6/2004 Aylward et al.
2004/0234076 A1 * 11/2004 Agostini ..... H04S 1/00 381/18
2005/0281408 A1 * 12/2005 Kim ..... H04S 3/002 381/17
2006/0045295 A1 * 3/2006 Kim ..... H04S 7/302 381/310
2006/0050909 A1 * 3/2006 Kim et al. ..... 381/309
2006/0133628 A1 * 6/2006 Trivi et al. ..... 381/310
2006/0251276 A1 11/2006 Chen
2007/0025559 A1 2/2007 Mihelich et al.
2007/0061026 A1 3/2007 Wang
2007/0074621 A1 4/2007 Chun
2007/0104331 A1 * 5/2007 Sawashi ..... H04S 7/302 381/18
2007/0104551 A1 5/2007 Gaiser
2007/0133831 A1 6/2007 Kim et al.
2007/0154019 A1 * 7/2007 Kim ..... H04S 1/00 381/17
2007/0291949 A1 * 12/2007 Imaki ..... H04S 5/00 381/17
2008/0008327 A1 1/2008 Ojala et al.
2008/0091436 A1 * 4/2008 Breebaart et al. ..... 704/500
2008/0159544 A1 * 7/2008 Kim ..... H04S 3/00 381/1
2008/0205675 A1 8/2008 Kutuzov et al.
2008/0232616 A1 9/2008 Pulkki et al.
2008/0243278 A1 10/2008 Dalton et al.
2008/0253578 A1 10/2008 Breebaart et al.
2008/0281408 A1 * 11/2008 Kodama ..... A61L 27/34 623/1.42
2009/0034764 A1 * 2/2009 Ohashi ..... 381/307
2009/0046864 A1 2/2009 Mahabub et al.
2009/0067636 A1 * 3/2009 Faure ..... H04S 1/00 381/17
2009/0110204 A1 * 4/2009 Walsh ..... G10L 19/16 381/17
2009/0252356 A1 10/2009 Goodwin et al.
2009/0319282 A1 12/2009 Allamanche et al.
2010/0150382 A1 6/2010 Ko et al.
2010/0158258 A1 6/2010 Sakurai et al.
2010/0183157 A1 * 7/2010 Watanabe ..... 381/17
2010/0322428 A1 * 12/2010 Fukui et al. ..... 381/17
2011/0021690 A1 * 1/2011 Nishimura et al. ..... 524/505
2011/0135098 A1 6/2011 Kuhr et al.
2012/0051565 A1 * 3/2012 Iwata ..... 381/300
2012/0155679 A1 * 6/2012 Van Dongen et al. ..... 381/304
2015/0088530 A1 3/2015 Oh et al.

FOREIGN PATENT DOCUMENTS

DE 10 2007 032 272 A1 1/2009
EP 0959644 A * 11/1999
EP 0959644 A2 11/1999
EP 1 219 140 B1 12/2003
JP 430700 A 2/1992
JP 10-285699 A 10/1998
JP 2000125399 A 4/2000
JP 2001-275195 A1 * 5/2001
JP 2001275195 A 10/2001
JP 200210400 A 1/2002
JP 2002218598 A 8/2002
JP 2003111200 A 4/2003
JP 2005-278125 A 10/2005
JP 2005278125 A * 10/2005
JP 2005-341208 A 12/2005
JP 2005341208 A * 12/2005
JP 2007228526 A 9/2007
JP 2009508433 A 2/2009
JP 200977379 A 4/2009
JP 2009260427 A 11/2009
KR 10-2005-0012085 A 1/2005
KR 10-0636251 B1 10/2006
RU 2365063 C2 8/2009
WO 9931938 A1 6/1999
WO 0019415 A2 4/2000
WO 2002025999 A2 3/2002
WO 02078388 A2 10/2002
WO WO 2006057521 A1 * 6/2006
WO 2008047833 A1 4/2008
WO 2008069597 A1 6/2008
WO 2009/001277 A1 12/2008
WO 2008155874 A1 12/2008
WO 2009/046223 A2 4/2009
WO 2009/056956 A1 5/2009
WO 2009/111798 A2 9/2009
WO 2010027882 A1 3/2010
WO 2010074893 A1 7/2010

OTHER PUBLICATIONS

Gan et al, Elevated speaker projection for digital home entertainment system, IEEE, 2001.*
Kim et al, Investigating Listeners localization of virtually elevated sound sources, AES,2010.*
Kim et al, Virtual ceiling speaker elevating auditory imagery in a 5 channel reproduction, AES, 2009.*
Hamasaki er al, Effectiveness of height information for reproducng presence and reality in multichannel audio system, AES, 2009.*
Lopez et al, Rear and Side Reproduction of elevated Sources in Wave Field Synthesis, EURASIP, 2009.*
Hamasaki et al, 5.1 and 22.2 Multichannel Sound productions using an Integrated Surround Sound Panning System, AES, 2004.*

(56) References Cited

OTHER PUBLICATIONS

Yang et al; High Fidelity Multichannel Audio Coding, EURASIP,2006.*
De Sousa et al, Two Approaches for hrtf iNTERPOLATION, SCBM2009.*
Communication dated Feb. 29, 2012 issued by the International Searching Authority in International Application No. PCT/KR2011/004937.
Communication, dated Apr. 8, 2014, issued by the Russian Patent Office in counterpart Russian Application No. 2013104985/28(007417).
Communication dated Nov. 1, 2013, issued by the Australian Intellectual Property Office in counterpart Australian Application No. 2011274709.
Communication dated Sep. 23, 2014, issued by the Russian Patent Office in counterpart Russian Application No. 2013104985/28(007417).
Communication dated Nov. 2, 2014, issued by the State Intellectual Property Office of P.R. China in counterpart Chinese Application No. 201180042811.2.
Communication dated Nov. 25, 2014, issued by the Australian Intellectual Property Office in counterpart Australian Application No. 2011274709.
Richard O. Duda, Oct. 17, 1999, http://www.ixbt.com/multimedia/3dsound-tech.html ; 8 pages total.
Communication dated Mar. 24, 2015, issued by the Japanese Intellectual Property Office in counterpart Japanese Application No. 2013-518274, 12 pages in Japanese and English.
Communication dated Mar. 26, 2015, issued by the Canadian Intellectual Property Office in counterpart Canadian Application No. 2804346.
Communication dated Apr. 24, 2015 issued by Russian Federation in counterpart Russian Patent Application No. 2013104985.
Communication dated Sep. 4, 2015 issued by the European Patent Office in counterpart European Patent Application No. 11803793.6.
Communication dated Nov. 4, 2016, issued by the State Intellectual Property Office of the People's Republic of China in counterpart Chinese Patent Application No. 201510818493.4.
Communication dated Mar. 21, 2017, issued by the Japanese Patent Office in counterpart Japanese Patent Application No. 2016-047473.
Communication dated Apr. 6, 2017, issued by the European Patent Office in counterpart European Patent Application No. 11803793.6.
Communication dated Aug. 30, 2017, by the Malaysian Patent Office in counterpart Malaysian Application No. PI 2013000036.
Communication dated Dec. 19, 2017, issued by the Japanese Patent Office in counterpart application No. 2016-047473.
Communication dated Feb. 6, 2017, issued by the European Patent Office in counterpart European Application No. 11803793.6.
Communication dated Mar. 21, 2018 by the India Intellectual Property Office in counterpart Indian Patent Application No. 268/MUMNP/2013.
Communication dated Mar. 28, 2018 by the Korean Intellectual Property Office in counterpart Korean Patent Application No. 10-2011-0034415.
Communication dated Apr. 3, 2018 by the Japanese Patent Office in counterpart Japanese Patent Application No. 2016-047473.
Communication dated May 11, 2018 by the Korean Intellectual Property Office in counterpart Korean Patent Application No. 10-2011-0034415.
Communication dated Apr. 10, 2019, issued by the Russian Patent Office in counterpart application No. 2015134326.
Communication dated Apr. 15, 2019, issued by the European Patent Office in counterpart European Application No. 11803793.6.
Kangeun Lee et al. "Immersive Virtual Sound Beyond 5.1 Channel Audio", Audio Engineering Society, May 1, 2010 (10 pages total) XP040509500.
Communication dated Aug. 13, 2019 issued by the Australian Intellectual Property Office in counterpart Australian Patent Application No. 2018211314.
Communication dated Sep. 13, 2019 issued by the Brazil Patent Office in counterpart Brazilian Application No. BR112013000328-6.
Communication dated Oct. 22, 2019, issued by the Russian Patent Office in counterpart Russian Application No. 2019118294.

* cited by examiner

3D SOUND REPRODUCING METHOD AND APPARATUS

CROSS-REFERENCE TO RELATED PATENT APPLICATIONS

This application claims the benefit of U.S. Provisional Application No. 61/362,014, filed on Jul. 7, 2010 in the United States Patent and Trademark Office, Korean Patent Application No. 10-2010-0137232, filed on Dec. 28, 2010, and Korean Patent Application No. 10-2011-0034415, filed on Apr. 13, 2011, in the Korean Intellectual Property Office, the disclosures of which are incorporated herein in their entirety by reference.

BACKGROUND

1. Field

Methods and apparatuses consistent with exemplary embodiments relate to reproducing three-dimensional (3D) sound, and more particularly, to localizing a virtual sound source to a predetermined elevation.

2. Description of the Related Art

With developments in video and sound processing technologies, contents having high image and sound quality are being provided. Users demanding contents having high image and sound quality now require realistic images and sound, and accordingly, research into 3D image and sound is being actively conducted.

3D sound is generated by providing a plurality of speakers at different positions on a level surface and outputting sound signals that are equal to or different from each other according to the speakers so that a user may experience a spatial effect. However, sound may actually be generated from various elevations, as well as various points on the level surface. Therefore, a technology for effectively reproducing sound signals that are generated at different levels from each other is necessary.

SUMMARY OF THE INVENTION

Exemplary embodiments provide a method and apparatus for reproducing 3D sound, and in particular, a method and apparatus for localizing a virtual sound source to a predetermined elevation.

According to an aspect of an exemplary embodiment, there is provided a 3D sound reproducing method, the method including: transmitting a sound signal through a predetermined filter generating 3D sound corresponding to a first elevation; replicating the filtered sound signal to generate a plurality of sound signals; performing at least one of amplifying, attenuating, and delaying on each of the replicated sound signals based on at least one of a gain value and a delay value corresponding to each of a plurality of speakers, through which the replicated sound signals are to be output; and outputting the sound signals that have undergone at least one of the amplifying, attenuating, and delaying processes through the corresponding speakers.

The predetermined filter may include head related transfer function (HRTF).

The transmitting the sound signals through the HRTF may include transmitting at least one of a left top channel signal representing a sound signal generated from a left side of a second elevation and a right top channel signal representing a sound signal generated from a right side of the second elevation through the HRTF.

The method may further include generating the left top channel signal and the right top channel signal by up-mixing the sound signal, when the sound signal does not include the left top channel signal and the right top channel signal.

The transmitting the sound signal through the HRTF may include transmitting at least one of a front left channel signal representing a sound signal generated from a front left side and a front right channel signal representing a sound signal generated from a front right side through the HRTF, when the sound signal does not include a left top channel signal representing a sound signal generated from a left side of a second elevation and a right top channel signal representing a sound signal generated from a right side of the second elevation.

The HRTF may be generated by dividing a first HRTF including information about a path from the first elevation to ears of a user by a second HRTF including information about a path from a location of a speaker, through which the sound signal will be output, to the ears of the user.

The outputting the sound signal may include: generating a first sound signal by mixing the sound signal that is obtained by amplifying the filtered left top channel signal according to a first gain value with the sound signal that is obtained by amplifying the filtered right top channel signal according to a second gain value; generating a second sound signal by mixing the sound signal that is obtained by amplifying the left top channel signal according to the second gain value with the sound signal that is obtained by amplifying the filtered right top channel signal according to the first gain value; and outputting the first sound signal through a speaker disposed on a left side and outputting the second sound signal through a speaker disposed on a right side.

The outputting the sound signals may include: generating a third sound signal by mixing a sound signal that is obtained by amplifying a rear left signal representing a sound signal generated from a rear left side according to a third gain value with the first sound signal; generating a fourth sound signal by mixing a sound signal that is obtained by amplifying a rear right signal representing a sound signal generated from a rear right side according to the third gain value with the second sound signal; and outputting the third sound signal through a left rear speaker and the fourth sound signal through a right rear speaker.

The outputting the sound signals may further include muting at least one of the first sound signal and the second sound signal according to a location on the first elevation, where the virtual sound source is to be localized.

The transmitting the sound signal through the HRTF may include: obtaining information about the location where the virtual sound source is to be localized; and determining the HRTF, through which the sound signal is transmitted, based on the location information.

The performing at least one of the amplifying, attenuating, and delaying processes may include determining at least one of the gain values and the delay values that will be applied to each of the replicated sound signals based on at least one of a location of the actual speaker, a location of a listener, and a location of the virtual sound source.

The determining at least one of the gain value and the delay value may include determining at least one of the gain value and the delay value with respect to each of the replicated sound signals as a determined value, when information about the location of the listener is not obtained.

The determining at least one of the gain value and the delay value may include determining at least one of the gain value and the delay value with respect to each of the replicated sound signals as an equal value, when information about the location of the listener is not obtained.

According to an aspect of another exemplary embodiment, there is provided a 3D sound reproducing apparatus including: a filter unit transmitting a sound signal through an HRTF corresponding to a first elevation; a replication unit generating a plurality of sound signals by replicating the filtered sound signal; an amplification/delay unit performing at least one of amplifying, attenuating, and delaying processes with respect to each of the replicated sound signals based on a gain value and a delay value corresponding to each of a plurality of speakers, through which the replicated sound signals are to be output; and an output unit outputting the sound signals that have undergone at least one of the amplifying, attenuating, and delaying processes through corresponding speakers.

BRIEF DESCRIPTION OF THE DRAWINGS

The above and other aspects will become more apparent by describing in detail exemplary embodiments with reference to the attached drawings in which.

DETAILED DESCRIPTION OF EXEMPLARY EMBODIMENTS

Hereinafter, exemplary embodiments will be described in detail with reference to accompanying drawings. In this description, the "term" unit means a hardware component and/or a software component that is executed by a hardware component such as a processor.

Figure 1:
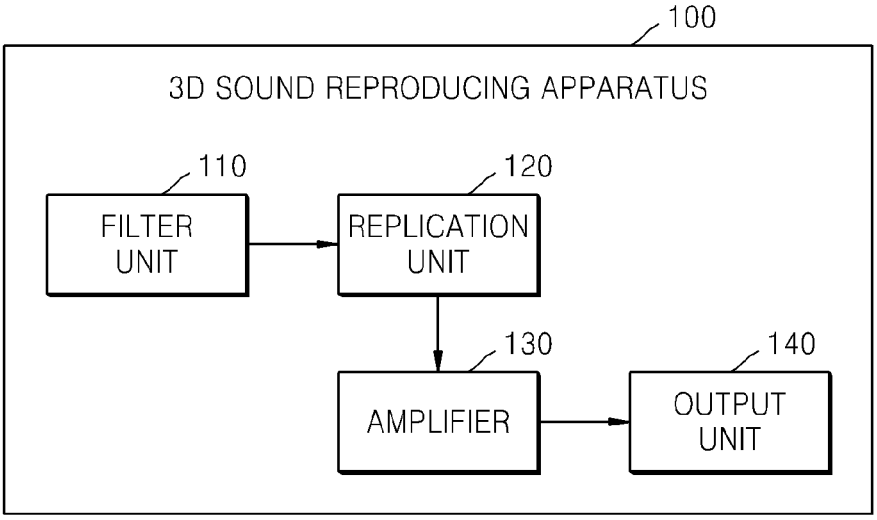
FIG. 1 is a block diagram of a 3D sound reproducing apparatus according to an exemplary embodiment.

FIG. 1 is a block diagram of a 3D sound reproducing apparatus 100 according to an exemplary embodiment.

The 3D sound reproducing apparatus 100 includes a filter unit 110, a replication unit 120, an amplifier 130, and an output unit 140.

The filter unit 110 transmits a sound signal through a predetermined filter generating 3D sound corresponding to a predetermined elevation. The filter unit 110 may transmit a sound signal through a head related transfer function (HRTF) corresponding to a predetermined elevation. The HRTF includes information about a path from a spatial position of a sound source to both ears of a user, that is, a frequency transmission characteristic. The HRTF makes a user recognize 3D sound by a phenomenon whereby complex passage characteristics such as diffraction at skin of human head and reflection by pinnae, as well as simple passage differences such as an inter-aural level difference (ILD) and an inter-aural time difference (ITD), are changed according to sound arrival directions. Since only one HRTF exists in each direction in a space, the 3D sound may be generated due to the above characteristics.

The filter unit 110 uses the HRTF filter for modeling a sound being generated from a position at an elevation higher than that of actual speakers that are arranged on a level surface. Equation 1 below is an example of HRTF used in the filter unit 110.

$$HRTF=HRTF_2/HRTF_1 \quad (1)$$

$HRTF_2$ is HRTF representing passage information from a position of a virtual sound source to the ears of a user, and $HRTF_1$ is HRTF representing passage information from a position of an actual speaker to the ears of the user. Since a sound signal is output from the actual speaker, in order for the user to recognize that the sound signal is output from a virtual speaker, $HRTF_2$ corresponding to a predetermined elevation is divided by $HRTF_1$ corresponding to the level surface (or elevation of the actual speaker).

An optimal HRTF corresponding to a predetermined elevation varies depending on each person, such as a fingerprint. However, it is impossible to calculate the HRTF for each user and to apply the calculated HRTF to each user. Thus, HRTF is calculated for some users of a user group, who have similar properties (for example, physical properties such as age and height, or propensities such as favorite frequency band and favorite music), and then, a representative value (for example, an average value) may be determined as the HRTF applied to all of the users included in the corresponding user group.

Equation 2 below is a result of filtering the sound signal by using the HRTF defined in Equation 1 above.

$$Y_2(f)=Y_1(f)*HRTF \quad (2)$$

$Y_1(f)$ is a value converted into a frequency band from the sound signal output that a user hears from the actual speaker, and $Y_2(f)$ is a value converted into a frequency band from the sound signal output that a user hear from the virtual speaker.

The filter unit 110 may only filter some channel signals of a plurality of channel signals included in the sound signal.

The sound signal may include sound signals corresponding to a plurality of channels. Hereinafter, a 7-channel signal is defined for convenience of description. However, the 7-channel signal is an example, and the sound signal may include a channel signal representing the sound signal generated from directions other than the seven directions that will now be described.

A center channel signal is a sound signal generated from a front center portion, and is output through a center speaker.

A front right channel signal is a sound signal generated from a right side of a front portion, and is output through a front right speaker.

A front left channel signal is a sound signal generated from a left side of the front portion, and is output through a front left speaker.

A rear right channel signal is a sound signal generated from a right side of a rear portion, and is output through a rear right speaker.

A rear left channel signal is a sound signal generated from a left side of the rear portion, and is output through a rear left speaker.

A right top channel signal is a sound signal generated from an upper right portion, and is output through a right top speaker.

A left top channel signal is a sound signal generated from an upper left portion, and is output through a left top speaker.

When the sound signal includes the right top channel signal and the left top channel signal, the filter unit 110 filters the right top channel signal and the left top channel signal. The right top signal and the left top signal that are filtered are then used to model a virtual sound source that is generated from a desired elevation.

When the sound signal does not include the right top signal and the left top signal, the filter unit 110 filters the front right channel signal and the front left channel signal. The front right channel signal and the front left channel signal are then used to model the virtual sound source generated from a desired elevation.

In some exemplary embodiments, the sound signal that does not include the right top channel signal and the left top channel signal (for example, 2.1 channel or 5.1 channel signal) is up-mixed to generate the right top channel signal and the left top channel signal. Then, the mixed right top channel signal and the left top channel signal may be filtered.

The replication unit 120 replicates the filtered channel signal into a plurality of signals. The replication unit 120 replicates the filtered channel signal as many times as the number of speakers through which the filtered channel signals will be output. For example, when the filtered sound signal is output as the right top channel signal, the left top channel signal, the rear right channel signal, and the rear left channel signal, the replication unit 120 makes four replicas of the filtered channel signal. The number of replicas made by the replication unit 120 may vary depending on the exemplary embodiments; however, it is desirable that two or more replicas are generated so that the filtered channel signal may be output at least as the rear right channel signal and the rear left channel signal.

The speakers through which the right top channel signal and the left top channel signal will be reproduced are disposed on the level surface. As an example, the speakers may be attached right above the front speaker that reproduces the front right channel signal.

The amplifier 130 amplifies (or attenuates) the filtered sound signal according to a predetermined gain value. The gain value may vary depending on the kind of the filtered sound signal.

For example, the right top channel signal output through the right top speaker is amplified according to a first gain value, and the right top channel signal output through the left top speaker is amplified according to a second gain value. Here, the first gain value may be greater than the second gain value. In addition, the left top channel signal output through the right top speaker is amplified according to the second gain value and the left top channel signal output through the left top speaker is amplified according to the first gain value so that the channel signals corresponding to the left and right speakers may be output.

In the related art, an ITD method has been mainly used in order to generate a virtual sound source at a desired position. The ITD method is a method of localizing the virtual sound source to a desired position by outputting the same sound signal from a plurality of speakers with time differences. The ITD method is suitable for localizing the virtual sound source at the same plane on which the actual speakers are located. However, the ITD method is not an appropriate way to localize the virtual sound source to a position that is located higher than an elevation of the actual speaker.

In exemplary embodiments, the same sound signal is output from a plurality of speakers with different gain values. In this manner, according to an exemplary embodiment, the virtual sound source may be easily localized to an elevation that is higher than that of the actual speaker, or to a certain elevation regardless of the elevation of the actual speaker.

The output unit 140 outputs one or more amplified channel signals through corresponding speakers. The output unit 140 may include a mixer (not shown) and a rendering unit (not shown).

The mixer mixes one or more channel signals.

The mixer mixes the left top channel signal that is amplified according to the first gain value with the right top channel signal that is amplified according to the second gain value to generate a first sound component, and mixes the left top channel signal that is amplified according to the second gain value and the right top channel signal that is amplified according to the first gain value to generate a second sound component.

In addition, the mixer mixes the rear left channel signal that is amplified according to a third gain value with the first sound component to generate a third sound component, and mixes the rear right channel signal that is amplified according to the third gain value with the second sound component to generate a fourth sound component.

The rendering unit renders the mixed or un-mixed sound components and outputs them to corresponding speakers.

The rendering unit outputs the first sound component to the left top speaker, and outputs the second sound component to the right top speaker. If there is no left top speaker or no right top speaker, the rendering unit may output the first sound component to the front left speaker and may output the second sound component to the front right speaker.

In addition, the rendering unit outputs the third sound component to the rear left speaker, and outputs the fourth sound component to the rear right speaker.

Operations of the replication unit 120, the amplifier 130, and the output unit 140 may vary depending on the number of channel signals included in the sound signal and the number of speakers. Examples of operations of the 3D sound reproducing apparatus according to the number of channel signals and speakers will be described later with reference to FIGS. 4 through 6.

Figure 2A:
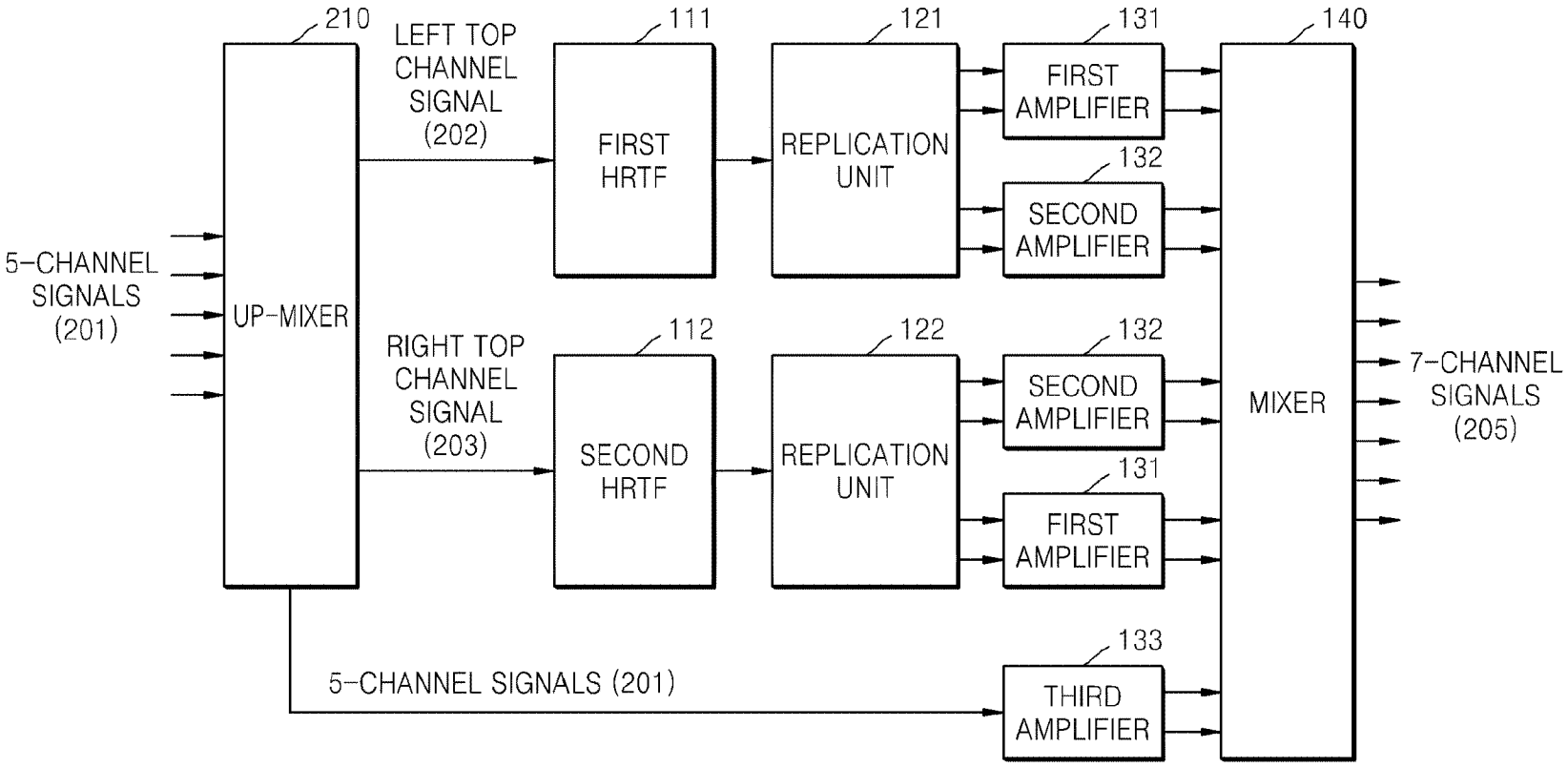
FIG. 2A is a block diagram of the 3D sound reproducing apparatus for localizing a virtual sound source to a predetermined elevation by using 5-channel signals.

FIG. 2A is a block diagram of a 3D sound reproducing apparatus 100 for localizing a virtual sound source to a predetermined elevation by using 5-channel signals according to an exemplary embodiment.

An up-mixer 210 up-mixes 5-channel signals 201 to generate 7-channel signals including a left top channel signal 202 and a right top channel signal 203.

The left top channel signal 202 is input into a first HRTF 111, and the right top channel signal 203 is input into a second HRTF 112.

The first HRTF 111 includes information about a passage from a left virtual sound source to the ears of the user, and the second HRTF 112 includes information about a passage from a right virtual sound source to the ears of the user. The first HRTF 111 and the second HRTF 112 are filters for modeling the virtual sound sources at a predetermined elevation that is higher than that of actual speakers.

The left top channel signal and the right top channel signal passing through the first HRTF 111 and the second HRTF 112 are input into replication units 121 and 122.

Each of the replication units 121 and 122 makes two replicas of each of the left top channel signal and the right top channel signal that are transmitted through the HRTFs 111 and 112. The replicated left top channel signal and right top channel signal are transferred to first to third amplifiers 131, 132, and 133.

The first amplifier 131 and the second amplifier 132 amplify the replicated left top signal and right top signal according to the speaker outputting the signal and the kind of the channel signals. In addition, the third amplifier 133 amplifies at least one channel signal included in the 5-channel signals 201.

In some exemplary embodiments, the 3D sound reproducing apparatus 100 may include a first delay unit (not shown) and a second delay unit (not shown) instead of the first and second amplifiers 131 and 132, or may include all of the first and second amplifiers 131 and 132, and the first and second delay units. This is because a same result as that of varying the gain value may be obtained when delayed values of the filtered sound signals vary depending on the speakers.

The output unit 140 mixes the amplified left top channel signal, the right top channel signal, and the 5-channel signal 201 to output the mixed signals as 7-channel signals 205. The 7-channel signals 205 are output to each of the speakers.

In another exemplary embodiment, when 7-channel signals are input, the up-mixer 210 may be omitted.

In another exemplary embodiment, the 3D sound reproducing apparatus 100 may include a filter determining unit (not shown) and an amplification/delay coefficient determining unit (not shown).

The filter determining unit selects an appropriate HRTF according to a position where the virtual sound source will be localized (that is, an elevation angle and a horizontal angle). The filter determining unit may select an HRTF corresponding to the virtual sound source by using mapping information between the location of the virtual sound source and the HRTF. The location information of the virtual sound source may be received through other modules such as applications (software or hardware), or may be input from the user. For example, in a game application, a location where the virtual sound source is localized may vary depending on time, and the filter determining unit may change the HRTF according to the variation of the virtual sound source location.

The amplification/delay coefficient determining unit may determine at least one of an amplification (or attenuation) coefficient and a delay coefficient of the replicated sound signal based on at least one of a location of the actual speaker, a location of the virtual sound source, and a location of a listener. If the amplification/delay coefficient determining unit does not recognize the location information of the listener in advance, the amplification/delay coefficient determining unit may select at least one of a predetermined amplification coefficient and a delay coefficient.

Figure 2B:
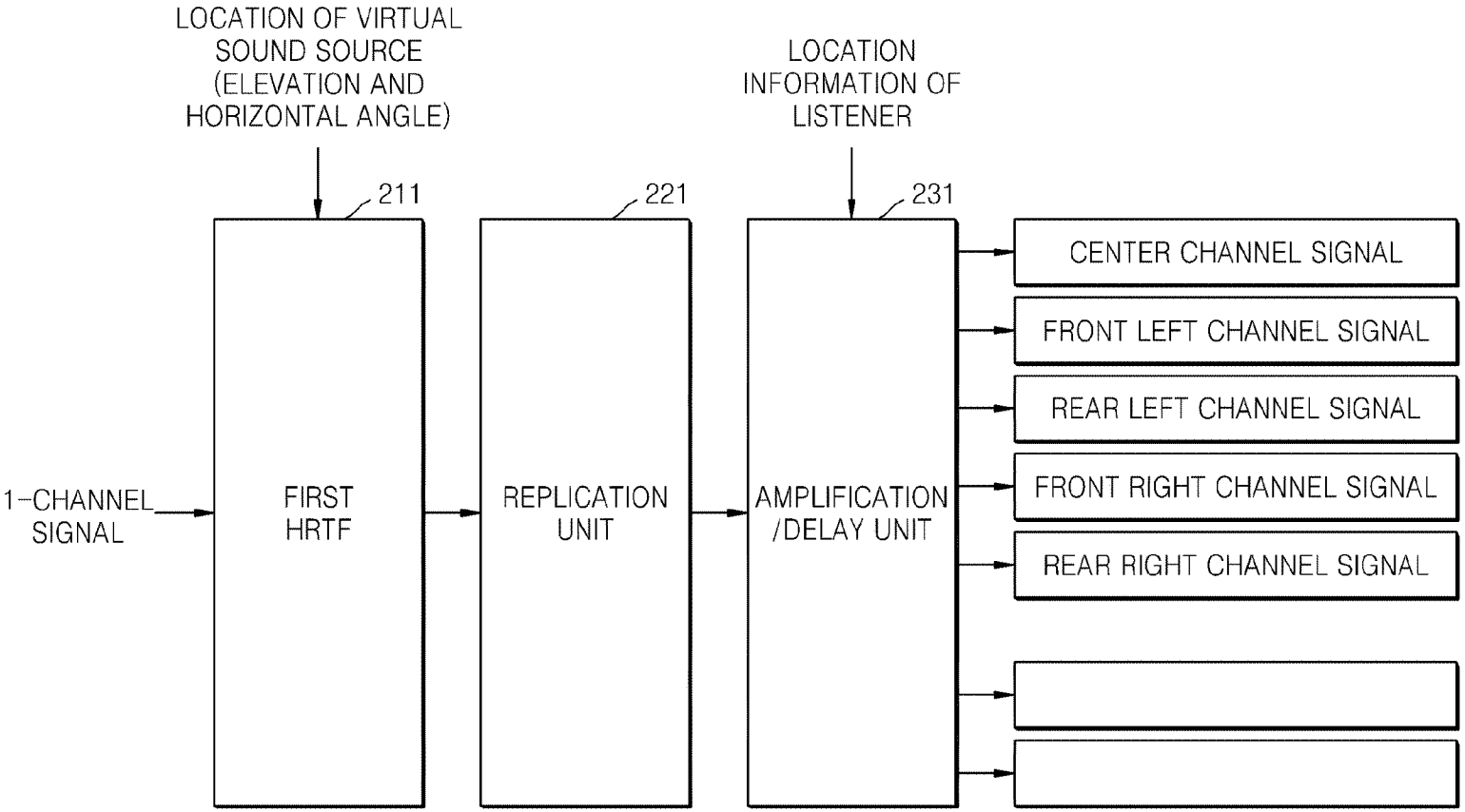
FIG. 2B is a block diagram of a 3D sound reproducing apparatus for localizing a virtual sound source to a predetermined elevation by using a sound signal according to another exemplary embodiment.

FIG. 2B is a block diagram of a 3D sound reproducing apparatus 100 for localizing a virtual sound source to a predetermined elevation by using a sound signal according to another exemplary embodiment.

In FIG. 2B, a first channel signal that is included in a sound signal will be described for convenience of description. However, the present exemplary embodiment may be applied to other channels signals included in the sound signal.

The 3D sound reproducing apparatus 100 may include a first HRTF 211, a replication unit 221, and an amplification/delay unit 231.

A first HRTF 211 is selected based on the location information of the virtual sound source, and the first channel signal is transmitted through the first HRTF 211. The location information of the virtual sound source may include elevation angle information and horizontal angle information.

The replication unit 221 replicates the first channel signal after being filtered into one or more sound signals. In FIG. 2B, it is assumed that the replication unit 221 replicates the first channel signal as many times as the number of actual speakers.

The amplification/delay unit 231 determines amplification/delay coefficients of the replicated first channel signals respectively corresponding to the speakers, based on at least one of location information of the actual speaker, location information of a listener, and location information of the virtual sound source. The amplification/delay unit 231 amplifies/attenuates the replicated first channel signals based on the determined amplification (or attenuation) coefficients, or delays the replicated first channel signal based on the delay coefficient. In an exemplary embodiment, the amplification/delay unit 231 may simultaneously perform the amplification (or attenuation) and the delay of the replicated first channel signals based on the determined amplification (or attenuation) coefficients and the delay coefficients.

The amplification/delay unit 231 generally determines the amplification/delay coefficient of the replicated first channel signal for each of the speakers; however, the amplification/delay unit 231 may determine the amplification/delay coefficients of the speakers to be equal to each other when the location information of the listener is not obtained, and thus, the first channel signals that are equal to each other may be output respectively through the speakers. In particular, when the amplification/delay unit 231 does not obtain the location information of the listener, the amplification/delay unit 231 may determine the amplification/delay coefficient for each of the speakers as a predetermined value (or an arbitrary value).

Figure 3:
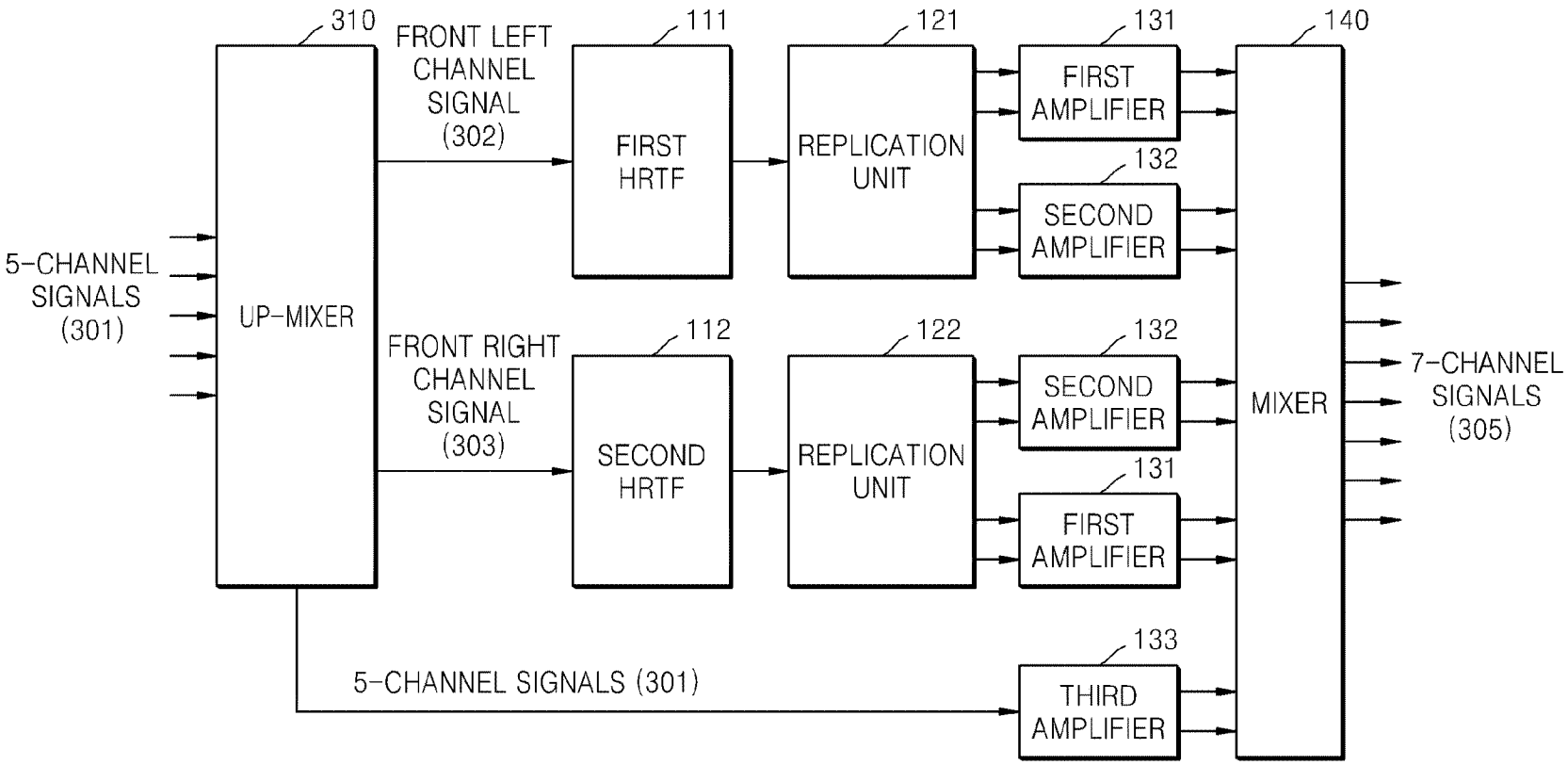
FIG. 3 is a block diagram of a 3D sound reproducing apparatus for localizing a virtual sound source to a predetermined elevation by using a 5-channel signal according to another exemplary embodiment.

FIG. 3 is a block diagram of a 3D sound reproducing apparatus 100 for localizing a virtual sound source to a predetermined elevation by using 5-channel signals according to another exemplary embodiment. A signal distribution unit 310 extracts a front right channel signal 302 and a front left channel signal 303 from the 5-channel signal, and transfers the extracted signals to the first HRTF 111 and the second HRTF 112.

The 3D sound reproducing apparatus 100 of the present exemplary embodiment is the same as that described with reference to FIG. 2 except that the sound components applied to the filtering units 111 and 112, the replication units 121 and 122, and the amplifiers 131, 132, and 133 are the front right channel signal 302 and the front left channel signal 303. Therefore, detailed descriptions of the 3D sound reproducing apparatus 100 of the present exemplary embodiment will not be provided here.

Figure 4:
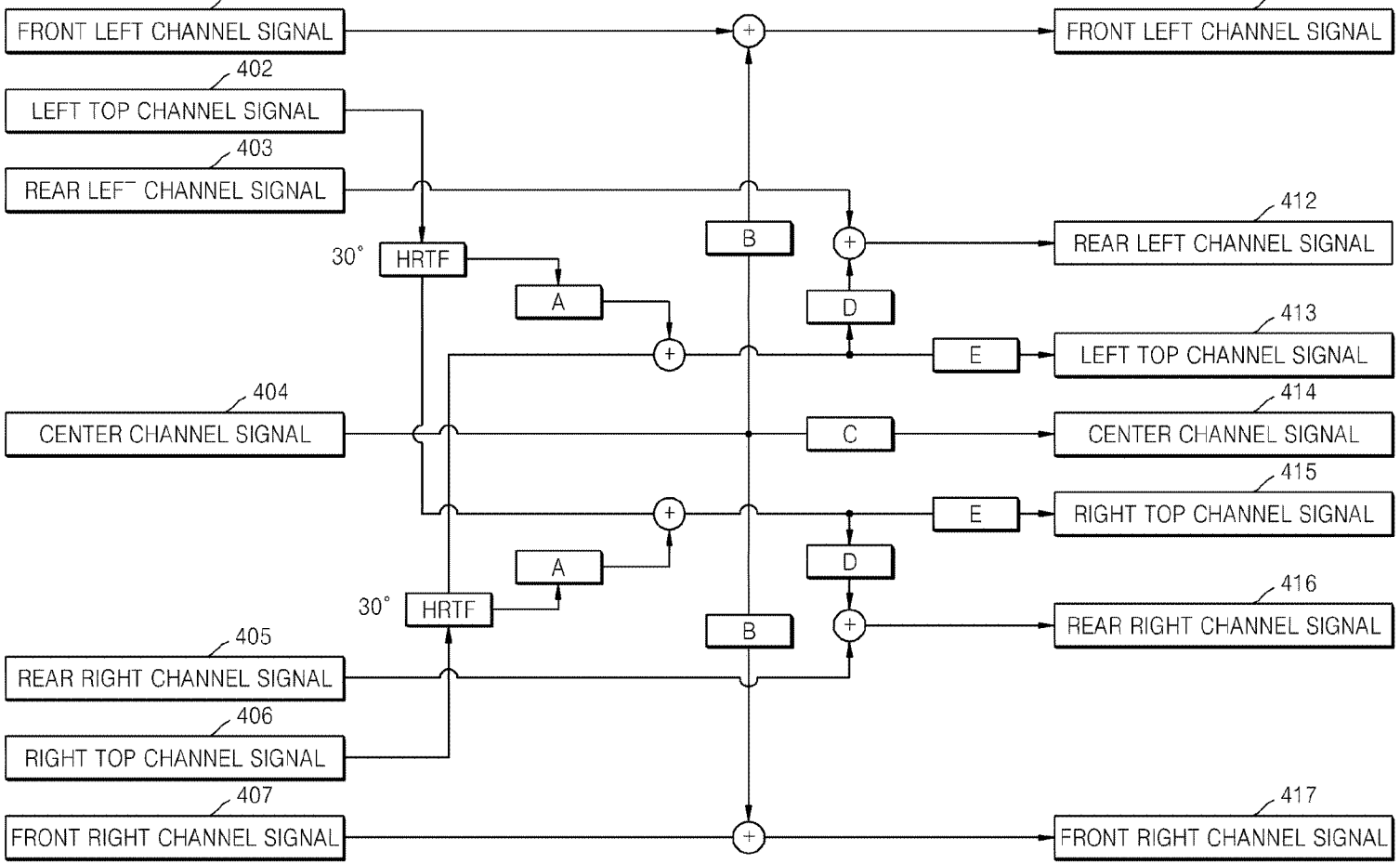
FIG. 4 is a diagram showing an example of a 3D sound reproducing apparatus for localizing a virtual sound source to a predetermined elevation by outputting 7-channel signals through 7 speakers according to an exemplary embodiment.

FIG. 4 is a diagram showing an example of a 3D sound reproducing apparatus 100 for localizing a virtual sound source to a predetermined elevation by outputting 7-channel signals through 7 speakers according to another exemplary embodiment.

FIG. 4 will be described based on input sound signals, and then, described based on sound signals output through speakers.

Sound signals including a front left channel signal, a left top channel signal, a rear left channel signal, a center channel signal, a rear right channel signal, a right top channel signal, and a front right channel signal are input in the 3D sound reproducing apparatus 100.

The front left channel signal is mixed with the center channel signal that is attenuated by a factor B, and then, is transferred to a front left speaker.

The left top channel signal passes through an HRTF corresponding to an elevation that is 30° higher than that of the left top speaker, and is replicated into four channel signals.

Two left top channel signals are amplified by a factor A, and then, mixed with the right top channel signal. In some exemplary embodiments, after mixing the left top channel signal that is amplified by the factor A with the right top channel signal, the mixed signal may be replicated into two signals. One of the mixed signals is amplified by a factor D, and then, mixed with the rear left channel signal and output through the rear left speaker. The other of the mixed signals is amplified by a factor E, and then, output through the left top speaker.

Two remaining left top channel signals are mixed with the right top channel signal that is amplified by the factor A. One of the mixed signals is amplified by the factor D, and then, is mixed with the rear right channel signal and output through the rear right speaker. The other of the mixed signals is amplified by the factor E, and is output through the right top speaker.

The rear left channel signal is mixed with the right top channel signal that is amplified by the factor D and the left top channel signal that is amplified by a factor D×A, and is output through the rear left speaker.

The center channel signal is replicated into three signals. One of the replicated center channel signals is attenuated by the factor B, and then, is mixed with the front left channel signal and output through the front left speaker. Another replicated center channel signal is attenuated by the factor B, and after that, is mixed with the front right channel signal and output through the front right speaker. The other of the replicated center channel signals is attenuated by a factor C, and then, is output through the center speaker.

The rear right channel signal is mixed with the left top channel signal that is amplified by the factor D and the right top channel signal that is amplified by the factor D×A, and then, is output through the rear right speaker.

The right top signal passes through an HRTF corresponding to an elevation that is 30° higher than that of the right top speaker, and then, is replicated into four signals.

Two right top channel signals are mixed with the left top channel signal that is amplified by the factor A. One of the mixed signals is amplified by the factor D, and is mixed with the rear left channel signal and output through the rear left speaker. The other of the mixed signals is amplified by the factor E, and is output through the left top speaker.

Two replicated right top channel signals are amplified by the factor A, and are mixed with the left top channel signals. One of the mixed signals is amplified by the factor D, and is mixed with the rear right channel signal and output through the rear right speaker. The other of the mixed signals is amplified by the factor E, and is output through the right top speaker.

The front right channel signal is mixed with the center channel signal that is attenuated by the factor B, and is output through the front right speaker.

Next, sound signals that are finally output through the speakers after the above-described processes are as follows:

(front left channel signal+center channel signal×B) is output through the front left speaker;

(rear left channel signal+D×(left top channel signal×A+right top channel signal)) is output through the rear left speaker;

(E×(left top channel signal×A+right top channel signal)) is output through the left top speaker;

(C×center channel signal) is output through the center speaker;

(E×(right top channel signal×A+left top channel signal)) is output through the right top speaker;

(rear right channel signal+D×(right top channel signal×A+left top channel signal)) is output through the rear right speaker; and (front right channel signal+center channel signal×B) is output through the front right speaker.

In FIG. 4, the gain values to amplify or attenuate the channel signals are merely examples, and various gain values that may make the left speaker and the right speaker output corresponding channel signals may be used. In addition, in some exemplary embodiments, gain values for outputting the channel signals that do not correspond to the speakers through the left and right speakers may be used.

Figure 5:
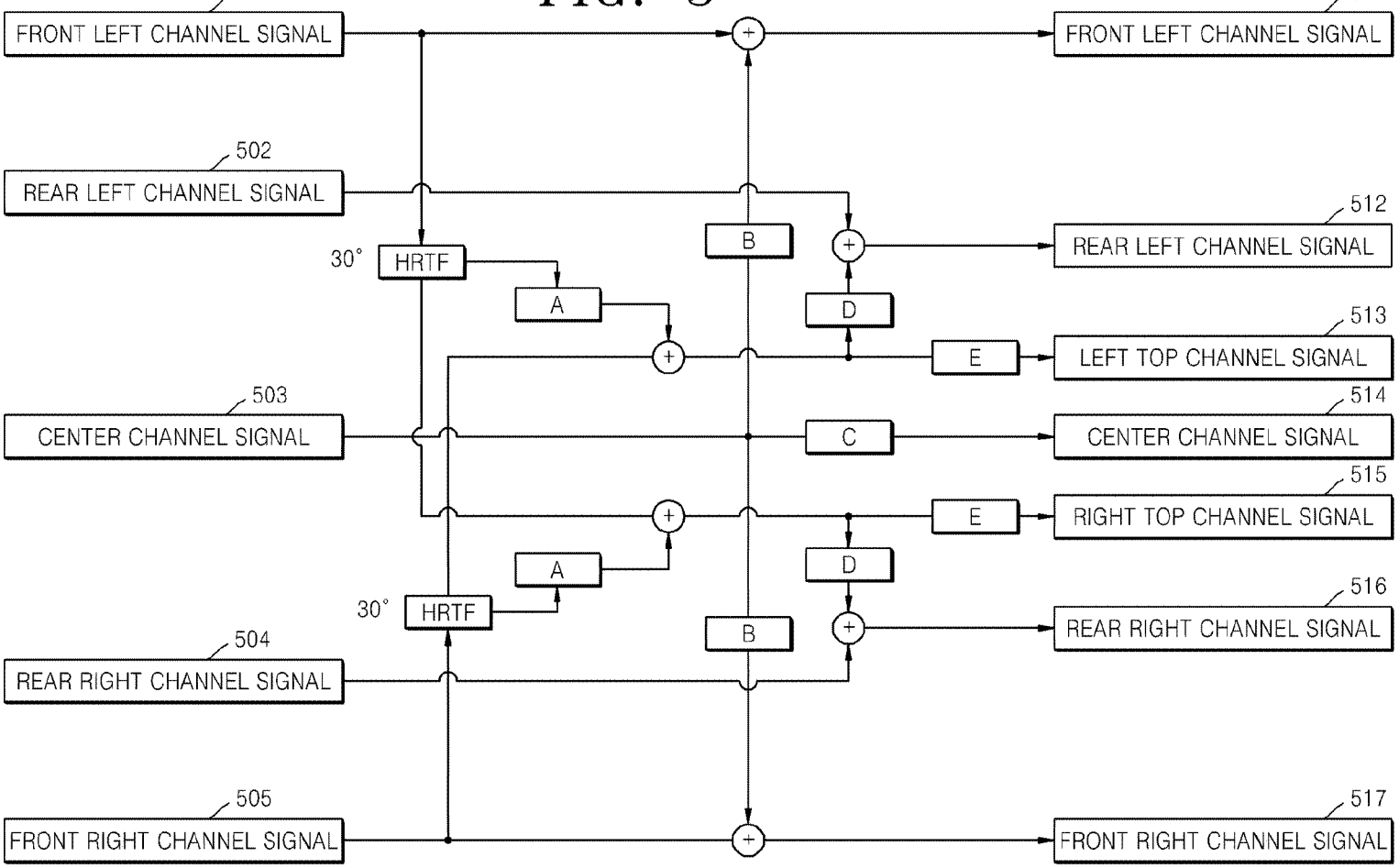
FIG. 5 is a diagram showing an example of a 3D sound reproducing apparatus for localizing a virtual sound source to a predetermined elevation by outputting 5-channel signals through 7 speakers according to an exemplary embodiment.

FIG. 5 is a diagram showing an example of a 3D sound reproducing apparatus 100 for localizing a virtual sound source to a predetermined elevation by outputting 5-channel signals through 7 speakers according to another exemplary embodiment.

The 3D sound reproducing apparatus shown in FIG. 5 is the same as that shown in FIG. 4 except that sound components input into an HRTF are a front left channel signal and a front right channel signal. Therefore, sound signals output through the speakers are as follows:

(front left channel signal+center channel signal×B) is output through the front left speaker;

(rear left channel signal+D×(front left channel signal×A+front right channel signal)) is output through the rear left speaker;

(E×(front left channel signal×A+front right channel signal)) is output through the left top speaker;

(C×center channel signal) is output through the center speaker;

(E×(front right channel signal×A+front left channel signal)) is output through the right top speaker;

(rear right channel signal+D×(front right channel signal×A+front left channel signal)) is output through the rear right speaker; and (front right channel signal+center channel signal×B) is output through the front right speaker.

Figure 6:
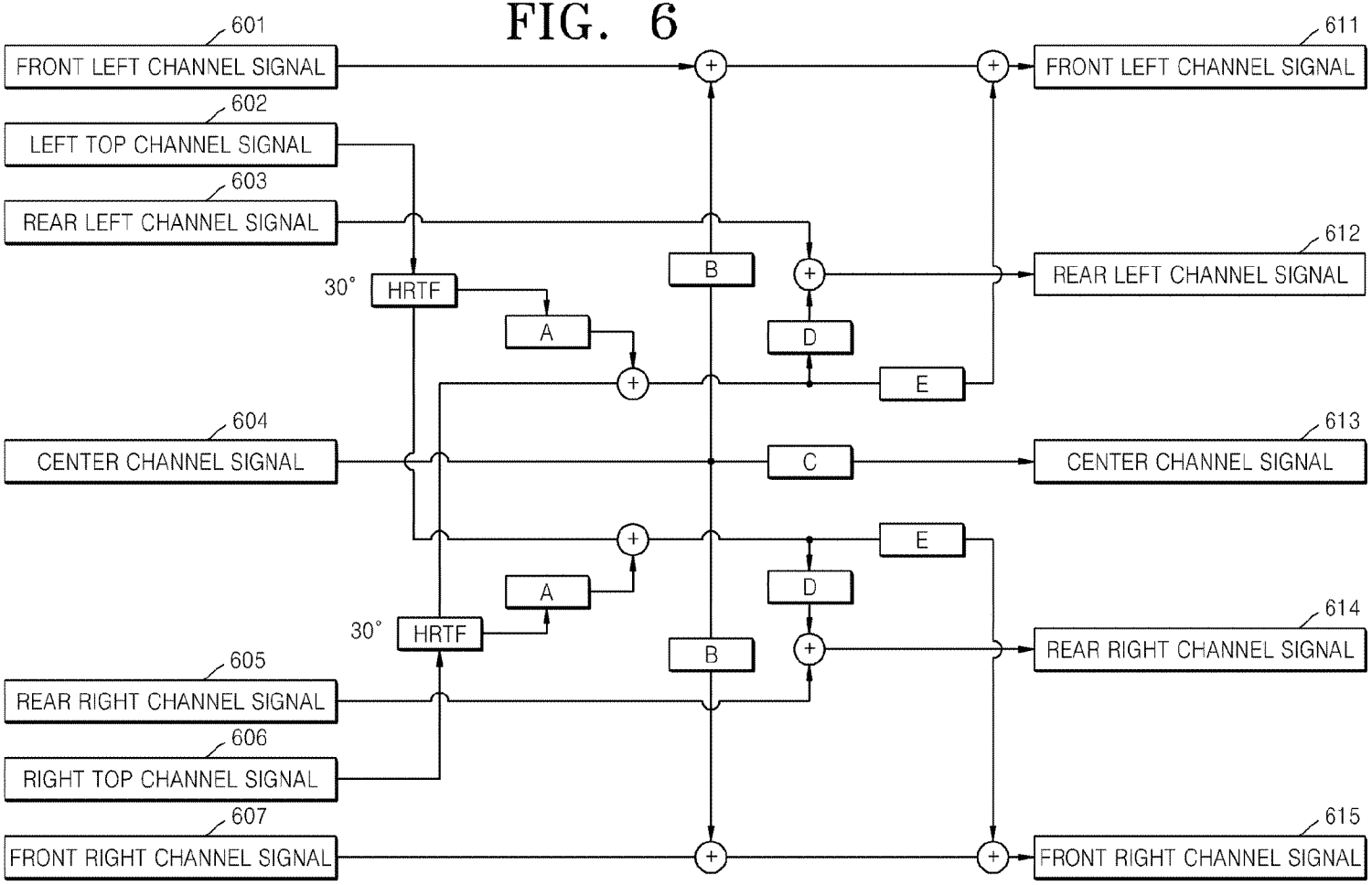
FIG. 6 is a diagram showing an example of a 3D sound reproducing apparatus for localizing a virtual sound source to a predetermined elevation by outputting 7-channel signals through 5 speakers according to an exemplary embodiment.

FIG. 6 is a diagram showing an example of a 3D sound reproducing apparatus 100 for localizing a virtual sound source to a predetermined elevation by outputting 7-channel signals through 5 speakers, according to another exemplary embodiment.

The 3D sound reproducing apparatus 100 of FIG. 6 is the same as that shown in FIG. 4 except for that the output signals that are supposed to output through the left top speaker (the speaker for the left top channel signal 413) and the right top speaker (the speaker for the right top channel signal 415) in FIG. 4, are output through the front left speaker (the speaker for the front left channel signal 611) and the front right speaker (the speaker for the front right channel signal 615) respectively. Therefore, sound signals output through the speakers are as follows:

(front left channel signal+(center channel signal×B)+E×(left top channel signal×A+right top signal)) is output through the front left speaker;

(rear left channel signal+D×(front left channel signal×A+front right channel signal)) is output through the rear left speaker;

(C×center channel signal) is output through the center speaker;

(E×(front right channel signal×A+front left channel signal)) is output through the right top speaker;

(rear right channel signal+D×(front right channel signal×A+front left channel signal)) is output through the rear right speaker; and (front right channel signal+(center channel signal×B)+E×(right top channel signal×A+left top channel signal)) is output through the front right speaker.

Figure 7:
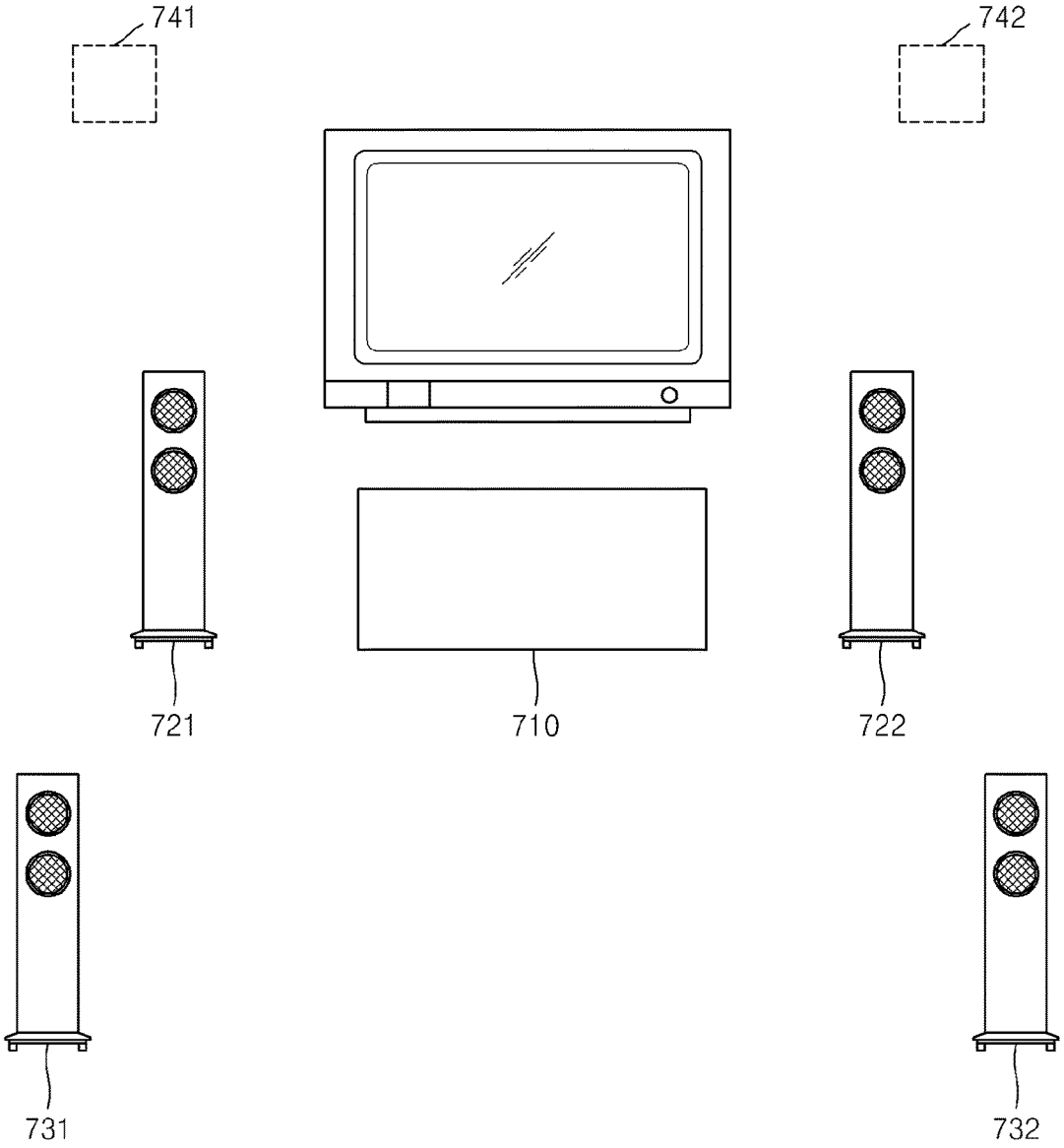
FIG. 7 is a diagram of a speaker system for localizing a virtual sound source to a predetermined elevation according to an exemplary embodiment.

FIG. 7 is a diagram of a speaker system for localizing a virtual sound source to a predetermined elevation according to an exemplary embodiment.

The speaker system of FIG. 7 includes a center speaker 710, a front left speaker 721, a front right speaker 722, a rear left speaker 731, and a rear right speaker 732.

As described above with reference to FIGS. 4 through 6, for localizing a virtual sound source to a predetermined elevation, a left top channel signal and a right top channel signal that have passed through a filter are amplified or attenuated by gain values that are different according to the speakers, and then, are input into the front left speaker 721, the front right speaker 722, the rear left speaker 731, and the rear right speaker 732.

Although not shown in FIG. 7, a left top speaker (not shown) and a right top speaker (not shown) may be disposed above the front left speaker 721 and the front right speaker 722. In this case, the left top channel signal and the right top channel signal passing through the filter are amplified by the gain values that are different according to the speakers and input into the left top speaker (not shown), the right top speaker (not shown), the rear left speaker 731, and the rear right speaker 732.

A user recognizes that the virtual sound source is localized to a predetermined elevation when the left top channel signal and the right top channel signal that are filtered are output through one or more speakers in the speaker system. Here, when the filtered left top channel signal or the right top channel signal is muted in one or more speakers, a location of the virtual sound source in a left-and-right direction may be adjusted.

When the virtual sound source is to be located at a center portion in a predetermined elevation, all of the front left speaker 721, the front right speaker 722, the rear left speaker 731, and the rear right speaker 732 output the filtered left top and right top channel signals, or only the rear left speaker 731 and the rear right speaker 732 may output the filtered left top and right top channel signals. In some exemplary embodiments, at least one of the filtered left top and right top channel signals may be output through the center speaker 710. However, the center speaker 710 does not contribute to the adjustment of the location of the virtual sound source in the left-and-right direction.

When it is desired that the virtual sound source be located at a right side in a predetermined elevation, the front right speaker 722, the rear left speaker 731, and the rear right speaker 732 may output the filtered left top and right top channel signals.

When it is desired that the virtual sound source be located at a left side in a predetermined elevation, the front left speaker 721, the rear left speaker 731, and the rear right speaker 732 may output the filtered left top and right top channel signals.

Even when it is desired that the virtual sound source be located at the right or left side in the predetermined elevation, the filtered left top and right top channel signals output through the rear left speaker 731 and the rear right speaker 732 may not be muted.

In some exemplary embodiments, the location of the virtual sound source in the left-and-right direction may be adjusted by adjusting the gain value for amplifying or attenuating the left top and right top channel signals, without muting the filtered left and right top channel signals output through one or more speakers.

Figure 8:
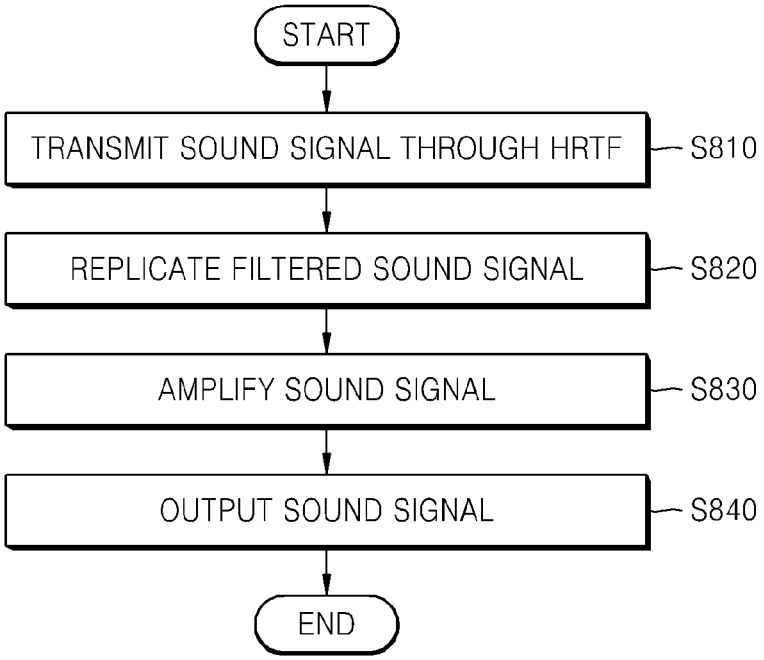
FIG. 8 is a flowchart illustrating a 3D sound reproducing method according to an exemplary embodiment.

FIG. 8 is a flowchart illustrating a 3D sound reproducing method according to an exemplary embodiment.

In operation S810, a sound signal is transmitted through an HRTF corresponding to a predetermined elevation.

In operation S820, the filtered sound signal is replicated to generate one or more replica sound signals.

In operation S830, each of the one or more replica sound signals is amplified according to a gain value corresponding to a speaker, through which the sound signal will be output.

In operation S840, the one or more amplified sound signals are output respectively through corresponding speakers.

In the related art, a top speaker is installed at a desired elevation in order to output a sound signal being generated at the elevation; however, it is not easy to install the top speaker on the ceiling. Thus, the top speaker is generally placed above the front speaker, which may cause a desired elevation to not be reproduced.

When the virtual sound source is localized to a desired location by using an HRTF, the localization of the virtual sound source may be performed effectively in the left-and-right direction on a horizontal plane. However, the localization using the HTRF is not suitable for localizing the virtual sound source to an elevation that is higher or lower than that of the actual speakers.

In contrast, according to the exemplary embodiments, one or more channel signals passing through the HRTF are amplified by gain values that are different from each other according to the speakers, and are output through the speakers. In this manner, the virtual sound source may be effectively localized to a predetermined elevation by using the speakers disposed on the horizontal plane.

The exemplary embodiments can be written as computer programs and can be implemented in general-use digital computers that execute the programs which are stored in a computer readable recording medium.

Examples of the computer readable recording medium include magnetic storage media (e.g., ROM, floppy disks, hard disks, etc.), and optical recording media (e.g., CD-ROMs, or DVDs).

While exemplary embodiments been particularly shown and described, it will be understood by those of ordinary skill in the art that various changes in form and details may be made therein without departing from the spirit and scope of the inventive concept as defined by the following claims.

What is claimed is:

1. A method of rendering an audio signal, the method comprising:

receiving input channel audio signals and an input channel configuration;

selecting a first head related transfer function (HRTF) based filter type according to a first height input channel signal among the input channel audio signals, wherein the first height input channel signal is identified by an azimuth and an elevation;

obtaining first gains according to the first height input channel signal and location information of a plurality of output channel audio signals;

downmixing the input channel audio signals, based on the first HRTF based filter type and the first gains, to provide elevated sound by the plurality of output channel audio signals; and outputting the plurality of output channel audio signals through a plurality of output speakers, wherein a configuration of the plurality of output channel audio signals is a 5.0 channel configuration, wherein the plurality of output speakers are located on a horizontal plane, and wherein the plurality of output channel audio signals comprise surround output channel signals.

2. The method of claim 1, wherein the first HRTF based filter type is selected based on a location of virtual output.

3. The method of claim 1, wherein the first height input channel signal is outputted to at least two of the plurality of output channel audio signals.

4. A non-transitory computer readable recording medium having embodied thereon a computer program for executing the method of claim 1.

5. The method of claim 1, the method further comprising:

selecting a second HRTF based filter type according to a second height input channel signal among the input channel audio signals, wherein the second height input channel signal is identified by an azimuth and an elevation; and obtaining second gains according to the second height input channel signal, wherein the first HRTF based filter type and the second HRTF based filter type are independently selected, wherein the first gains and the second gains are independently obtained, wherein the elevation rendering is performed on the input channel audio signals based on the second HRTF based filter type and the second gains.

6. The method of claim 1, wherein a surround output channel signal among the surround output channel signals is identified by at least one of 110 degree azimuth and −110 degree azimuth.

7. The method of claim 1, wherein a surround output channel signal among the surround output channel signals is identified by 0 degree elevation.

8. The method of claim 1, wherein the first height input channel signal is located at top center.

9. The method of claim 1, wherein gains for a rear left channel signal and a rear right channel signal included in the surround output channel signals among the first gains are non-zero positive values.

10. The method of claim 1, wherein the input channel configuration comprises the azimuth and the elevation of the first height input channel signal.

11. An apparatus for rendering an audio signal, the apparatus comprising:

a receiver, implemented by at least one processor, configured to receive input channel audio signals and an input channel configuration;

a renderer, implemented by at least one processor, configured to:

select a first head related transfer function (HRTF) based filter type according to a first height input channel signal among the input channel audio signals, wherein the first height input channel signal is identified by an azimuth and an elevation, configured to obtain first gains according to the first height input channel signal and location information of a plurality of output channel audio signals, and configured to perform downmixing on the input channel audio signals, based on the first HRTF based filter type and the first gains, to provide elevated sound by the plurality of output channel audio signals and output the plurality of output channel audio signals through a plurality of output speakers, wherein the plurality of output speakers are located on a horizontal plane, wherein a configuration of the plurality of output channel audio signals is a 5.0 channel configuration, and wherein the plurality of output channel audio signals comprise surround output channel signals.

12. The apparatus of claim 11, wherein the first HRTF based filter type is selected based on a location of virtual output.

13. The apparatus of claim 11, wherein the first height input channel signal is outputted to at least two of the plurality of output channel audio signals.

14. The apparatus of claim 11, wherein the renderer is further configured to select a second HRTF based filter type according to a second height input channel signal among the input channel audio signals, wherein the second height input channel signal is identified by an azimuth and an elevation and obtaining second gains according to the second height input channel signal, wherein the first HRTF based filter type and the second HRTF based filter type are independently selected, wherein the first gains and the second gains are independently obtained, wherein the elevation rendering is performed on the second height input channel signal based on the second HRTF based filter type and the second gains.

15. The apparatus of claim 11, wherein a surround output channel signal is identified by at least one of 110 degree azimuth and −110 degree azimuth.

16. The apparatus of claim 11, wherein a surround output channel signal is identified by 0 degree elevation.

17. The apparatus of claim 11, wherein the first height input channel signal is located at top center.

18. The apparatus of claim 11, wherein gains for a rear left channel signal and a rear right channel signal included in the surround output channel signals among the first gains are non-zero positive values.

19. The apparatus of claim 11, wherein the input channel configuration comprise the azimuth and the elevation of the first height input channel signal.

* * * * *